US010446298B2

(12) United States Patent
Mörth et al.

(10) Patent No.: US 10,446,298 B2
(45) Date of Patent: Oct. 15, 2019

(54) METHOD FOR PRODUCING AN ELECTRICAL COMPONENT

(71) Applicant: EPCOS AG, München (DE)

(72) Inventors: Josef Mörth, St. Martin I.S. (AT); Gilbert Landfahrer, Deutschlandsberg (AT); Gerald Kloiber, Feldkirchen (AT); Anna Moshammer, Graz (AT)

(73) Assignee: EPCOS AG, München (DE)

( * ) Notice: Subject to any disclaimer, the term of this patent is extended or adjusted under 35 U.S.C. 154(b) by 0 days.

(21) Appl. No.: 15/741,286

(22) PCT Filed: Jun. 28, 2016

(86) PCT No.: PCT/EP2016/065038
§ 371 (c)(1),
(2) Date: Jan. 1, 2018

(87) PCT Pub. No.: WO2017/001415
PCT Pub. Date: Jan. 5, 2017

(65) Prior Publication Data

US 2018/0197662 A1 Jul. 12, 2018

(30) Foreign Application Priority Data

Jul. 1, 2015 (DE) ..... 10 2015 110 607

(51) Int. Cl.
*H01C 1/144* (2006.01)
*H01C 17/065* (2006.01)
(Continued)

(52) U.S. Cl.
CPC ..... *H01C 7/043* (2013.01); *H01C 1/01* (2013.01); *H01C 1/142* (2013.01); *H01C 1/144* (2013.01);
(Continued)

(58) Field of Classification Search
CPC ..... H01C 7/043; H01C 1/01; H01C 1/143; H01C 7/44; H01C 17/065; H01C 17/12; H01C 17/06546
See application file for complete search history.

(56) References Cited

U.S. PATENT DOCUMENTS 4,647,895 A 3/1987 Howng
5,084,426 A * 1/1992 Iwaya ..... C04B 35/472 252/520.2
(Continued)

FOREIGN PATENT DOCUMENTS

CN 103943290 A 7/2014
DE 1193582 B 5/1965
(Continued)

OTHER PUBLICATIONS

WO2012000386, Naito et al. (Year: 2012).*

*Primary Examiner* — Kyung S Lee
(74) *Attorney, Agent, or Firm* — Slater Matsil, LLP

(57) ABSTRACT

A method for producing an electrical component is disclosed. In an embodiment the method includes providing a carrier element providing a material having a temperature-dependent resistance, applying the material on a surface of the carrier element for producing a resistance layer on the carrier element and subsequently sintering the resistance layer for linking the resistance layer to the carrier element.

11 Claims, 3 Drawing Sheets

(51) Int. Cl.

| | |
|---|---|
| ***H01C 1/142*** | (2006.01) |
| ***H01C 17/28*** | (2006.01) |
| ***H01C 7/04*** | (2006.01) |
| ***H01C 1/01*** | (2006.01) |
| ***H01C 1/14*** | (2006.01) |
| ***H01C 7/00*** | (2006.01) |

(52) U.S. Cl.

CPC ..... *H01C 1/1413* (2013.01); *H01C 7/003* (2013.01); *H01C 7/044* (2013.01); *H01C 17/065* (2013.01); *H01C 17/06533* (2013.01); *H01C 17/28* (2013.01); *H01C 17/06546* (2013.01)

(56) References Cited

U.S. PATENT DOCUMENTS

| | | | | | |
|---|---|---|---|---|---|
| 5,246,628 | A * | 9/1993 | Jung | H01C 7/043 | 252/519.5 |
| 5,491,118 | A | 2/1996 | Hormadaly | | |
| 5,805,049 | A * | 9/1998 | Yamada | H01O 3/04 | 338/22 R |
| 6,469,612 | B2 * | 10/2002 | Nakayama | B32B 18/00 | 252/519.1 |
| 7,948,354 | B2 * | 5/2011 | Miura | H01C 7/18 | 338/22 R |
| 8,518,554 | B2 * | 8/2013 | Naba | B23K 35/30 | 428/621 |
| 8,624,703 | B2 * | 1/2014 | Miura | H01C 7/008 | 338/22 R |
| 9,357,643 | B2 * | 5/2016 | Yano | C04B 37/026 | |
| 2008/0311428 | A1 * | 12/2008 | Mori | C01G 45/1264 | 428/701 |
| 2010/0134237 | A1 * | 6/2010 | Miura | C04B 35/016 | 338/22 R |
| 2012/0168209 | A1 * | 7/2012 | Kato | H01L 23/15 | 174/255 |
| 2014/0291699 | A1 | 10/2014 | Yano et al. | | |

FOREIGN PATENT DOCUMENTS

| | | | |
|---|---|---|---|
| DE | 69514633 | T2 | 6/2000 |
| DE | 102013226294 | A1 | 6/2015 |
| EP | 0895252 | A1 | 2/1999 |
| JP | S6095976 | A | 5/1985 |
| JP | S625603 | A | 1/1987 |
| JP | S6225402 | | 2/1987 |
| JP | H0792034 | A | 4/1995 |
| JP | H07307208 | A | 11/1995 |
| JP | 2003217903 | A | 7/2003 |
| WO | 02075751 | A1 | 9/2002 |
| WO | 2009129463 | A1 | 10/2009 |
| WO | 2012111386 | A1 | 8/2012 |
| WO | 2013094213 | A1 | 6/2013 |

* cited by examiner

METHOD FOR PRODUCING AN ELECTRICAL COMPONENT

This patent application is a national phase filing under section 371 of PCT/EP2016/065038, filed Jun. 28, 2016, which claims the priority of German patent application 10 2015 110 607.8, filed Jul. 1, 2015, each of which is incorporated herein by reference in its entirety.

TECHNICAL FIELD

The invention relates to a method for producing an electrical component, in particular, for producing an electrical component having a temperature-dependent resistance characteristic. The invention furthermore relates to an electrical component, in particular an electrical component having a temperature-dependent resistance characteristic.

BACKGROUND

Electrical components having a temperature-dependent resistance behavior can be used for measuring temperatures. In the case of NTC components, the electrical resistance decreases, for example, as the temperature rises. Such electrical components comprise a material whose resistance value is dependent on the ambient temperature. The temperature-sensitive resistance material is usually arranged in a housing of the component, for example, an SMD housing. In order to measure a temperature of a body, the components are usually arranged by their housing on the surface of the body.

The disadvantage of such an arrangement is that the thermal coupling of the material having the temperature-dependent resistance characteristic to the body whose temperature is intended to be determined is not optimal on account of the surrounding housing of the component. By way of example, an air gap is present between the temperature-sensitive material and the housing of the component, said air gap influencing the heat transfer from the surface of the body to the temperature-sensitive material and ultimately corrupting the temperature measurement.

SUMMARY OF THE INVENTION

Embodiments provide a method for producing an electrical component in which the coupling of a material that is temperature-sensitive with regard to its resistance to a surface of a body whose temperature is intended to be determined is improved. Furthermore, embodiments provide an electrical component in which the coupling of the material that is temperature-sensitive with respect to its resistance to the surface of a body whose temperature is intended to be determined is improved.

Embodiments provide a carrier element and a material having a temperature-dependent resistance. The material is arranged on a surface of the carrier element for producing a resistance layer. For linking the resistance layer to the carrier element, the resistance layer is subsequently sintered.

If the surface temperature of a body, for example, the surface temperature of a container, is intended to be measured, it is necessary for an electrical insulation to be present between the body and the temperature-dependent resistance layer of the component. Furthermore, a good thermal conductivity ought to be present between the surface of the body whose temperature is intended to be measured and the temperature-sensitive material of the resistance layer. Therefore, a non-electrically conductive material is preferably used for the carrier element. An electrically conductive ceramic, for example, an NTC thermistor material in the case of an NTC component, can be used for the resistance layer.

By combining a non-electrically conductive carrier material with an electrically conductive ceramic, the specified method provides a novel method for producing temperature-sensitive electrical components which can be used to fabricate components whose resistance layer can be coupled well to a support via the carrier element.

A non-sintered material is preferably used for the resistance layer. By way of example, a calcined metal oxide powder can be used. A screen-printable ceramic paste is produced from this starting material. The paste can be applied onto the carrier element in the form of arbitrary structures. The structures can be printed, for example, onto the material of the carrier element. At the time of printing, the temperature-sensitive material of the resistance layer does not yet have its final properties. The material assumes the final properties only after the sintering process.

The stability of such an arrangement composed of a non-sintered material having a temperature-dependent resistance and a carrier element to which the material is fixedly linked by a sintering process only after the printing of the paste has a significantly higher stability than if pastes, in particular sintered pastes, were used which already had their final properties upon being applied onto the carrier element. By printing the material having the temperature-dependent resistance onto the carrier element, it is possible realize complex resistance structures. Furthermore, the method affords the advantage of miniaturization.

By means of the specified production method, it is thus possible to realize a temperature sensor element whose sensitive ceramic layer is fixedly linked to the electrically nonconductive, but thermally highly conductive material of the carrier element by means of a sintering process. It is thus possible to satisfy the requirements of temperature measuring applications in which a temperature sensor element is coupled via planar surfaces, wherein a maximum thermal coupling is affected and the thermal mass can be minimized.

One embodiment of such an electrical component is specified in patent claim 11. The electrical component comprises a carrier element and a resistance layer composed of a material having a temperature-dependent resistance. The resistance layer is arranged on a surface of the carrier element and is linked to the carrier element by a sintering process.

Further embodiments of the method for producing the electrical component and of the electrical component can be gathered from the dependent claims.

BRIEF DESCRIPTION OF THE DRAWINGS

The invention is explained in greater detail below with reference to figures showing exemplary embodiments of the method for producing the electrical component and embodiments of the electrical component. In the figures.

DETAILED DESCRIPTION OF ILLUSTRATIVE EMBODIMENTS

Figure 1:
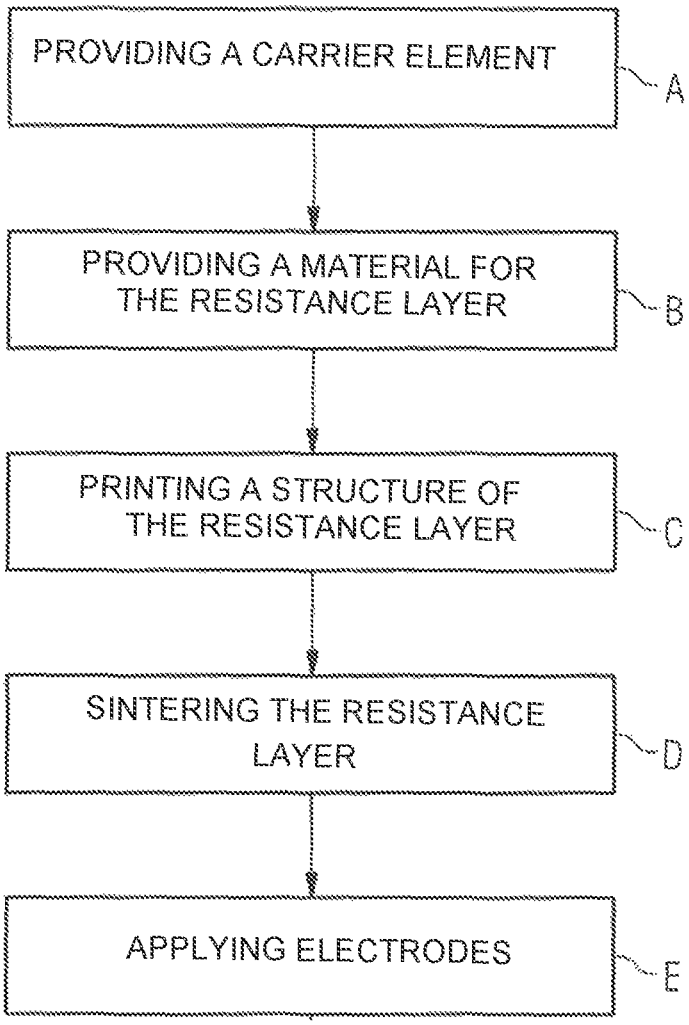
FIG. 1 shows one embodiment of a method for producing a temperature-sensitive electrical component.

FIG. 1 shows one embodiment of a method for producing a temperature-sensitive electrical component 1. Various embodiments of the electrical component 1 are shown in the subsequent FIGS. 2A, 2B, 3A and 3B. The method is explained below with reference to FIG. 1, and in the process reference is also made to the embodiments of the method that are shown in FIGS. 2A to 3B.

In a method step A, firstly a carrier element 10 is provided. In a method step B, a material having a temperature-dependent resistance is furthermore provided. In a method step C, the material is applied on a surface O10 of the carrier element 10 for producing a resistance layer 20 on the carrier element. Afterward, in a method step D, the resistance layer 20 is sintered for linking the resistance layer 20 to the carrier element 10. In a method step E, electrodes 30*a*, 30*b* are applied to the electrical component produced until then, for applying a voltage to the resistance layer 20 of the component. At least one of the electrodes 30*a* and 30*b* can be arranged on a surface O20 of the resistance layer 20 or on a further surface U10 of the carrier element 10.

FIGS. 2A, 2B, 3A and 3B illustrate various embodiments of the electrical component 1 which has been produced by the method sequence depicted schematically in FIG. 1. The temperature-sensitive electrical component 1 comprises the carrier element 10 and also the resistance layer 20 composed of a material having a temperature-dependent resistance. The resistance layer 20 is arranged on the surface O10 of the carrier element 10 and is linked to the carrier element 10 by a sintering process.

For applying a voltage to the resistance layer 20, the temperature-sensitive electrical component in FIGS. 2A to 3B furthermore comprises the electrodes 30*a* and 30*b*. At least one of the electrodes 30*a* and 30*b* is arranged on the surface O20 of the resistance layer 20 or on a further surface U10 of the carrier element 10.

In method step A, the carrier element 10 is preferably provided from a non-electrically conductive material. The carrier layer 10 of the electrical component shown in FIGS. 2A to 3B therefore preferably comprises for the carrier element 10 a material which is not electrically conductive. Furthermore, in method step A, the carrier element 10 can preferably be provided from a material having thermally highly conductive properties. The carrier element 10 can be provided, for example, from a material having a thermal conductivity of at least 15 W/K. The electrical component 1 shown in FIGS. 2A to 3B therefore preferably comprises a thermally highly conductive material, for example, a material having a thermal conductivity of at least 15 W/K.

In method step A, the carrier element 10 can be provided, for example, from a material composed of aluminum oxide or aluminum nitride or combinations thereof. In a manner corresponding to method step A, the electrical component shown in FIGS. 2A to 3B can therefore comprise a material composed of aluminum oxide or aluminum nitride or composed of combinations thereof. The carrier element 10 can have a thickness of between 100 μm and 2 mm.

In method step B, the material of the resistance layer 20 is provided before applying the resistance layer on the carrier element 10, for example, as a material which is not sintered. The material of the resistance layer 20 can be provided as a calcined metal oxide which is not sintered. In particular, in method step B, the resistance layer 20 can be provided from a material composed of nickel oxide, manganese oxide, copper oxide, zinc oxide or composed of combinations thereof.

In a manner corresponding to method step B, the temperature-sensitive electrical component 1 shown in FIGS. 2A to 3B preferably comprises a non-sintered material as material for the resistance layer 20. The resistance layer 20 can contain, for example, a calcined metal oxide which is not sintered. In particular, the resistance layer 20 can contain nickel oxide, manganese oxide, copper oxide, zinc oxide or combinations thereof. The resistance layer 20 can have a layer thickness of between 5 μm and 15 μm.

In accordance with one possible embodiment of the method, firstly, in method step B, before applying the resistance layer 20 onto the carrier element 10, the material of the resistance layer 20 can be provided as a screen-printable ceramic paste which is not yet sintered and therefore does not yet have its final properties. In the subsequent method step C, before the actual sintering of the resistance layer 20, a structure of the resistance layer 20 can be printed onto the carrier element 10. The structure of the resistance layer 20 can be printed onto the carrier element 10 by means of a screen printing method, in particular, before the resistance layer is sintered and thereby fixedly linked to the carrier element.

The printable paste can be embodied as a metal oxide-ceramic powder mixture having an NTC characteristic. Since the paste is not yet sintered when it is applied onto the carrier element, the material of the resistance layer 20 does not yet have its final properties at the time of printing, and it assumes said final properties only after the sintering process. The stability of the temperature-sensitive electrical component is therefore higher than if pastes were used which already had their final properties upon being applied onto the carrier element 10, for example, pastes containing a sintered material. The production of the screen-printable ceramic paste makes it possible to print arbitrary structures onto the material of the carrier element 10 and to link them thermally and mechanically to the material of the carrier element 10.

Owing to the use of the carrier element as a substrate onto which the temperature-dependent resistance layer is applied, the temperature-sensitive electrical component has a high mechanical stability. Furthermore, the electrical component has a high thermal conductivity and at the same time ensures an electrical insulation between the material of the resistance layer 20 and a support onto which the carrier element 10 is applied.

Figure 2A:
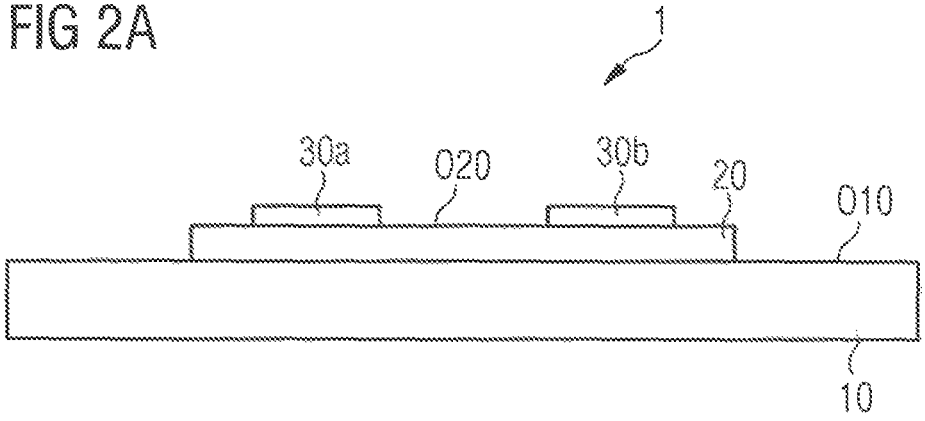
FIG. 2A shows one embodiment of a temperature-sensitive electrical component.
Figure 2B:
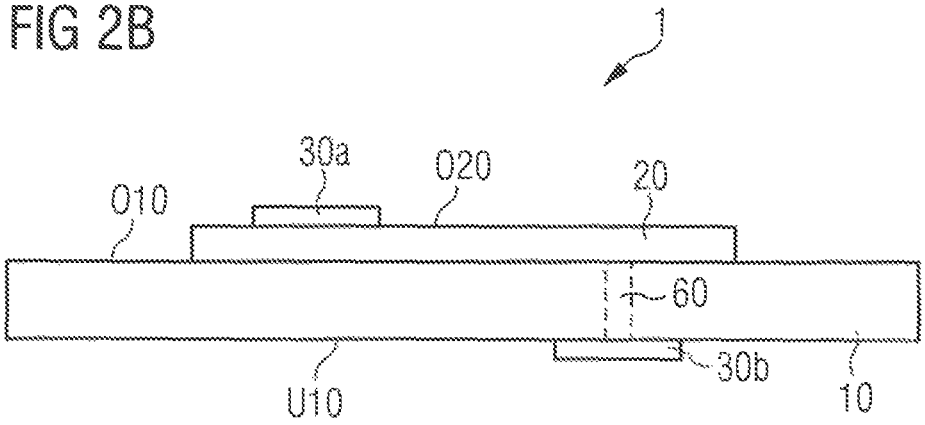
FIG. 2B shows a further embodiment of a temperature-sensitive electrical component.

In the embodiment of the electrical component as shown in FIG. 2A, the electrodes 30*a* and 30*b* for applying a voltage to the resistance layer 20 are applied on the surface O20 of the resistance layer 20. The two electrodes 30*a* and 30*b* can be arranged, for example, on the top side of the resistance layer 20. In the embodiment of the electrical component 1 as shown in FIG. 2B, one of the electrodes 30*a* is arranged on the surface O20 of the resistance layer 20 and a further electrode 30*b* is arranged on a surface U10 of the carrier element 10. The electrode 30*a* can be applied, for example, on the top side of the resistance layer 20. The electrode 30*b* can be arranged on the underside of the carrier element 10. The electrode 30*b* can be connected to the resistance layer 20, for example, via a plated-through hole 60 through the carrier element 10. The electrodes 30*a* and 30*b* can be applied by means of a screen printing or sputtering method onto the surface O20 of the resistance layer 20 or onto the surface U10 of the carrier element 10.

Figure 3A:
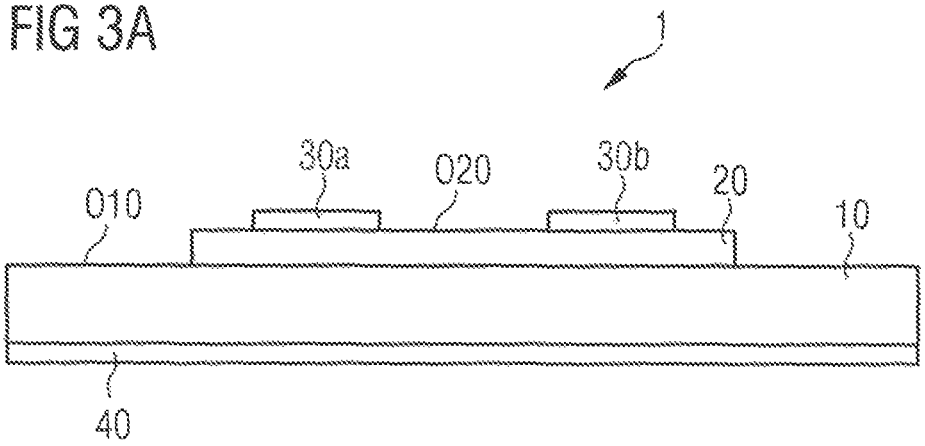
FIG. 3A shows a further embodiment of a temperature-sensitive electrical component.

FIG. 3A shows the embodiment of the temperature-sensitive electrical component 1 shown in FIG. 2A, wherein an adhesive layer 40 for adhesively bonding the electrical component 1 onto a support is additionally arranged on the underside U10 of the carrier element 10. The adhesive layer 40 can be a highly thermally conductive adhesive, for example, with which the underside U10 of the carrier element 10 is coated. When using the temperature-sensitive electrical component 1 in the embodiment shown in FIG. 3A, a user can adhesively bond the carrier element 10, by means of the adhesive layer 40 applied to the underside of the carrier element 10, directly onto the surface of a body whose temperature is to be measured. As an alternative thereto, a user can also himself/herself provide the underside U10 of the carrier element 10 with an adhesive layer 40.

Figure 3B:
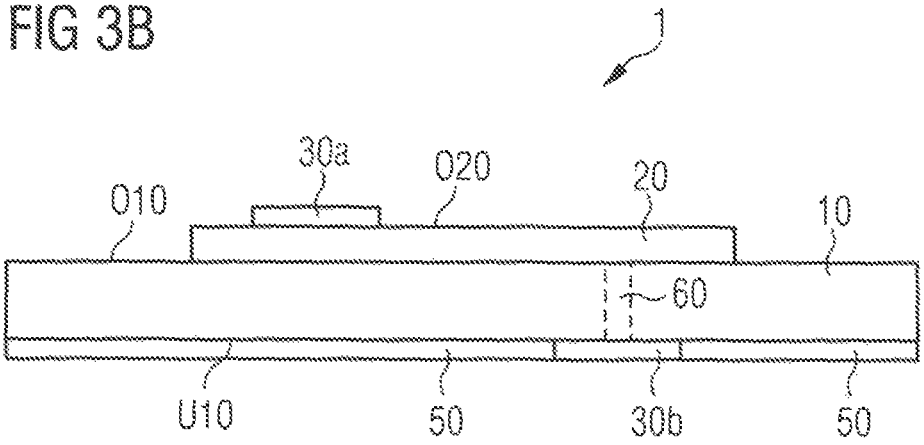
FIG. 3B shows a further embodiment of a temperature-sensitive electrical component.

FIG. 3B shows an embodiment of the temperature-sensitive electrical component 1 corresponding to the configuration shown in FIG. 2B, wherein the underside U10 of the carrier element 10 is coated with a silver layer 50. The silver layer 50 makes it possible to solder the carrier element 10 onto a support in order to determine the temperature of the support.

The invention claimed is:

1. A method for producing an electrical component, the method comprising:

providing a carrier element;

providing a material having a temperature-dependent resistance;

applying the material on a surface of the carrier element for producing a resistance layer on the carrier element; and subsequently sintering the resistance layer for linking the resistance layer to the carrier element, wherein the material of the resistance layer is provided as a screen-printable ceramic paste before the resistance layer is applied onto the carrier element, and wherein a structure of the resistance layer is printed onto the carrier element before the resistance layer is sintered by a screen printing method.

2. The method according to claim 1, further comprising applying electrodes for applying a voltage to the resistance layer, wherein the electrodes are arranged on a surface of the resistance layer.

3. The method according to claim 1, wherein the carrier element comprises a non-electrically conductive material having a thermal conductivity of at least W/K.

4. The method according to claim 1, wherein the carrier element comprises a material composed of aluminum oxide, aluminum nitride or combinations thereof.

5. The method according to claim 1, wherein the material is applied a calcined metal oxide.

6. The method according to claim 1, wherein the resistance layer comprises a material composed of nickel oxide, manganese oxide, copper oxide, zinc oxide or composed of combinations thereof.

7. The method according to claim 2, wherein applying the electrodes comprises applying the electrodes by a screen printing or sputtering method onto the surface of the resistance layer.

8. The method according to claim 1, wherein the resistance layer is applied onto a top side of the carrier element, and wherein an adhesive layer is applied onto an underside of the carrier element in order to adhesively bond the electrical component onto a support.

9. The method according to claim 1, wherein the resistance layer is applied onto a top side of the carrier element, wherein a silver layer is applied onto an underside of the carrier element in order to solder the electrical component onto a support.

10. The method according to claim 1, wherein the carrier element has a thickness between 100 μm and 17 mm inclusive, and wherein the resistance layer has a layer thickness of between 5 μm and 15 μm inclusive.

11. The method according to claim 1, wherein the carrier element contains a material composed of aluminum oxide or aluminum nitride or combinations thereof, and wherein the resistance layer comprises a calcined metal oxide.

* * * * *